United States Patent [19]

Taddicken

[11] Patent Number: 4,572,094

[45] Date of Patent: Feb. 25, 1986

[54] SEWING MACHINE WITH WORKPIECE DIFFERENTIAL TRANSPORT DEVICE

[75] Inventor: Hermann Taddicken, Schwäbisch-Gmünd, Fed. Rep. of Germany

[73] Assignee: Eisele Apparate-und Gerätebau GmbH, Fed. Rep. of Germany

[21] Appl. No.: 651,604

[22] Filed: Sep. 17, 1984

[30] Foreign Application Priority Data

Sep. 17, 1983 [DE] Fed. Rep. of Germany ... 8326790[U]

[51] Int. Cl.[4] ..... D05B 27/16

[52] U.S. Cl. ..... 112/322; 112/153; 112/121.26; 112/121.15; 112/305; 112/313

[58] Field of Search ..... 112/318, 322, 121.26, 112/158 B, 121.15, 153, 136, 305, 313, 121.11

[56] References Cited

U.S. PATENT DOCUMENTS

| | | | |
|---|---|---|---|
| 2,630,772 | 3/1953 | Ederer | 112/136 X |
| 3,590,758 | 7/1971 | Hughes | 112/287 |
| 3,726,240 | 4/1973 | Emich | 112/322 X |
| 4,109,595 | 8/1978 | Ducol et al. | 112/121.11 |
| 4,290,376 | 9/1981 | Brusasca et al. | 112/322 X |

*Primary Examiner*—Werner H. Schroeder
*Assistant Examiner*—Andrew M. Falik
*Attorney, Agent, or Firm*—McGlew and Tuttle

[57] ABSTRACT

A feed device for feeding a material pattern cut to a sewing machine for the forming of stitch groups such as a row of button holes by a reciprocating needle operating on the material pattern which is advanced through the needle path and moved in a draw-off path, comprising a draw-off roll arranged alongside the needle in a position to engage the material. The draw-off roll is arranged on a shaft which is coupled through a sleeve to another shaft containing a transport roller forming part of a material transport. Drive means are connected to drive the shafts of the draw-off roller and a laterally arranged transport roller and a drive belt is interconnected between the transport roller and a second transport roller which extends rearwardly thereof and is located at the turning point of the material draw-off. This second transport roller has a higher circumferential speed than the first transport roller and it protrudes through an opening in a lead guide for the material to engage the material and send it off in a draw-off direction. The apparatus also includes a deflecting bar which is oriented to contact the material at the location of the first draw-off roll. The free length of the rod corresponds substantially to the expanse of the pattern cut in the region of the deflecting edge of the lead guide.

8 Claims, 4 Drawing Figures

SEWING MACHINE WITH WORKPIECE DIFFERENTIAL TRANSPORT DEVICE

FIELD AND BACKGROUND OF THE INVENTION

This invention relates in general to sewing machines, and in particular to a sewing machine for the forming of stitch groups such as a row of buttonholes.

A similar sewing machine is known from U.S. Pat. No. 3,463,101. In that machine, the workpiece is a shirt front which is laid around a deflecting bar attached to the sewing table at an angle to the sewing direction. The workpiece is aligned, and then clamped at the front end into a feed device which displaces the shirt front from one buttonhole sewing point to the next and at the rear end into a return device, before the sewing of the individual buttonholes can be started. After completeion of the buttonhole row, the workpiece must be unclamped. The clamping and unclamping takes relatively much time and causes long down times of the sewing machine.

An extension spring is provided as drive means for the return device, which is increasingly tensioned during the intermittent shifting of the shirt front between the sewing operations. The stepped increase of the spring tension has the result that the shirt front is subjected to a different tensile stress at each sewing point. Because of the tensile stress, the working of knit material and other stretchable materials is not possible on the known machine, because the work easily buckles. Furthermore, because of the different stretch of the shirt front at the individual sewing points depending on spring tension and type of work, uniform distances between the buttonholes are not assured. But because uniform distances between the buttonholes are an essential quality feature of clothing, special care must be given to this aspect in making production more efficient.

SUMMARY OF THE INVENTION

The invention provides an improved sewing machine which operates in such a way that clamping and unclamping of the pattern cut is eliminated, and the cut is transported from one buttonhole sewing point to the next without tension so that perfectly identical distances between the buttonholes of a buttonhole row are maintained regardless of the type of work.

By elimination of the clamping device, the invention permits a rapid changing of the machine, so that a significant rationalization effect is achieved. Virtually all kinds of textiles can be worked without a problem, and defects attributable to buckling are ruled out. The transport means, protruding into the draw-off path of the work lying at an angle to the sewing direction, prevents contraction during displacement from one sewing point to the next and ensures satisfactory guiding.

Accordingly it is an object of the invention to provide an improved indexing device for moving a material pattern cut to a sewing machine and away from the sewing machine in a draw-off direction.

A further object of the invention is to provide an indexing device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
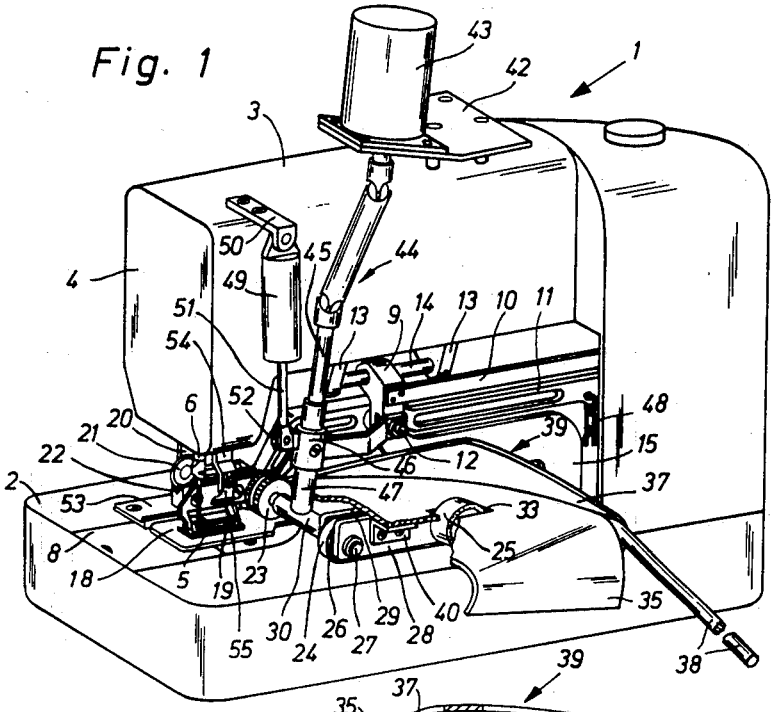
FIG. 1 is a simplified perspective view of a buttonhole sewing machine with an indexing device constructed in accordance with the invention.

Referring to the drawings in particular the invention embodied therein comprises an indexing device for moving a material pattern cut or workpiece to a sewing machine for the forming of stitch groups such as a row of buttonholes. The material or workpiece W is fed into association with a reciprocating needle 5 and is advanced through needle path and moved off in the draw-off path. The draw-off mechanism includes a draw-off roller 23 which engages the material as it enters the draw-off path. First transport means in the form of a roller 26 carrying a belt 24 contacts the material spaced laterally from the draw-off roller 23. Second transport means in the form of a roller 25 is spaced from the first transport means and is connected for driving therewith by the belt 24. In accordance with the invention, the drive comprises a common step motor 43 driving through a multi-part cardan shaft 44 which has a lower part 45 guided in the sleeve 47.

The buttonhole sewing machine, marked 1, is a conventional model. The machine housing includes a material supporting plate 2 and a machine arm 3 with a head 4 in which is arranged a needle bar 6 carrying the needle 5 and movable up and down in pendulum motion crosswise to the work displacement direction, arrow V. Needle 5 cooperates for stitch formation with a shuttle (not shown) disposed in the cloth support plate 2 under the stitch plate 7 and under the slide 8.

Figure 3:
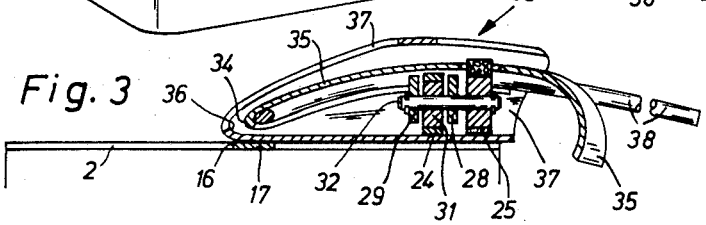
FIG. 3 is a section taken along line III—III of FIG. 2.

The reciprocating displacement of the workpiece by the length of a buttonhole during buttonhole sewing under the needle bar 6 working in pendulum motion crosswise to the displacement or sewing direction, arrow V, occurs through a control disc customary in buttonhole sewing machines and therefore not illustrated, which acts on a push rod 10 connected with a slide block 9. A cloth clamp support lever 11 is mounted pivotably about a bolt 12 on the slide block 9. The slide block 9 slides on a rod 14 fastened in bearings 13 of the machine arm 3. Through bolt 12 the slide block 9 and the cloth clamp support lever 11 are connected with a yoke 15 which is screwed to a cursor 17 guided in a groove 16 (FIG. 3) of the cloth support plate 2 for displacement parallel to the work displacement direction, arrow V. At the needle side end of said cursor 17, a cloth holding plate 18 is secured. The pattern cut W to be placed on the cloth holding plate 18 is pressed against the plate 18 by a cloth clamp 19 fastened to the front end of the cloth clamp support lever 11, namely by a spring acting on the presser bar 20 via a pressure roller 21 which is rotatably mounted at the lower end of the presser bar and braces itself in a V shaped notch 22 in the front end of lever 11.

The device for the intermittent displacing of the pattern cut W comprises a draw-off roller 23 following the stitch formation point of the sewing machine, an endless belt 24 in parallel and laterally spaced relation thereto, and an additional roller 25 with an elastic covering. The draw-off roll 23 and the front guide wheel 26 of the endless belt 24 are secured on a transverse shaft 27 which is mounted in two fishplates 28,29 and is received in a transverse sleeve 30. The rear guide wheel 31 of the endless belt 24 is secured on a shaft 32 mounted in the fishplates 28,29. On the end of shaft 32 protruding from fishplate 28, the roller 25 is secured. The diameter of roller 25 is somewhat greater than the distance between the sections of the endless belt 24. Roller 25 protrudes through an opening 33 of the inner guide plate 35 with a deflection edge 34 of a lead guide 39 consisting of the guide plate and of an outer guide plate 37 with lead edge 36 as well as of a downwardly inclined deflection rod 38 at the deflection edge 34 of the inner guide plate 35, into the draw-off path of the pattern cut W.

In the embodiment shown, the deflection edges 34 and 36 of the guide plates 35, 37 extend at an angle of about 40° to the feed or sewing direction, arrow V. The length of the deflection rod 38 corresponds more or less to the expanse of the pattern cut W in the region of the deflection edges 34, 36, in order to completely support the pattern cut during its deflection.

The inner guide plate 35 has an attachment bracket 40 and is screwed to the fishplate 28, and the outer guide plate 37 has an attachment bracket 41 and is screwed to the cursor 17. To create a passage space for insertion of the pattern cut W, the guide plates 35,37 are arranged, in their operating position, at a corresponding distance from each other.

As common drive means for the draw-off roller 23, for the endless belt 24, and for roller 25, a step motor 43 disposed on support 42 (FIG. 1) is provided which via multi-part cardan shaft 44 whose lower part 45 is guided in sleeve 47, and via an angle drive, not illustrated in detail, drives the transverse shaft 27 with the draw-off roll 23 and with the front guide wheel 26 of the endless belt 24. The sleeve 47 is connected through bolt 12 with the slide block 9 by means of a clamp 46.

For insertion of a pattern cut W, the cloth clamp support lever 11 is pivotable about bolt 12 by a pull chain 48 connected with a pedal (not shown). The cloth clamp 19, draw-off roller 23 and the front part of the fishplates 28,29 are raisable by a compressed air cylinder 49 which is articulated at one end to a bracket 50 attached to the machine housing and whose piston rod 51 is connected with a hinge piece 52 secured on sleeve 47. To facilitate the lateral guiding of the pattern cut W, a ruler or guide 53 is secured on the cloth support plate 2.

Lastly, a buttonhole knife 55, arranged on a bar 54 to be operated by the control disc of the sewing machine at the end of each buttonhole sewing operation, serves to cut open the buttonhole slit. The knife 55 penetrates into a slot 56 in the stitch plate 7, the front end of which is widened to a transverse slit 57 for passage of the needle 5.

The mode of operation is as follows:

For inserting a shirt pattern cut W on which a buttonhole row is to be sewn, the cloth clamp support lever 11 is pivoted about bolt 12 by pedal actuation through pull chain 48. This causes the cloth clamp 19 to be lifted. In addition, by the compressed air cylinder 49 to be actuated, e.g. by a switch via a solenoid valve, the draw-off roller 23 and the inlet region of the endless belt 24 placed around the guide wheels 26, 31 mounted in the fishplates 28,29 are lifted. Then, with the sewing point of the first buttonhole aligned with the needle, the pattern cut W is placed on the cloth holding plate 18 under cloth clamp 19 and is inserted with the front edge under the draw-off roller 23 and the inlet region of the endless belt 24, which extends to just before the deflection edges 34, 36 of the lead guide 39. Thereupon the cloth clamp support lever 11 with cloth clamp 19 is lowered onto the pattern cut W, clamp 19 pressing the cut pattern W against the cloth holding plate 18 by the presser bar 20 under spring action over the roller 21 taking support in the V-shaped notch. The draw-off roller 23 and the endless belt 24 are also lowered onto the pattern cut W.

Figure 2:
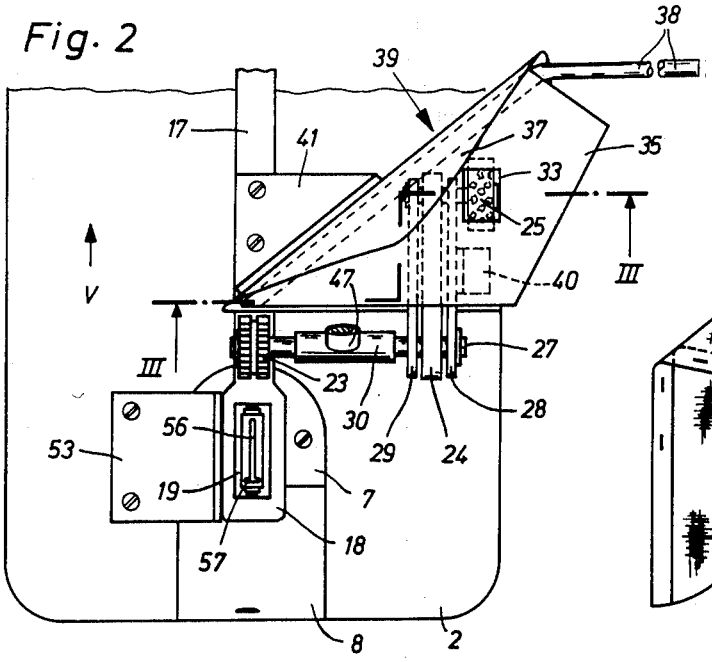
FIG. 2 is a somewhat enlarged plan view of the indexing device and of the lead guide for the work.
Figure 4:
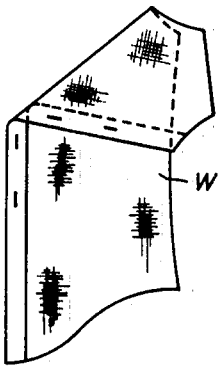
FIG. 4 is a plan view of a shirt front partly deflected at an angle to the sewing direction shown in a smaller scale.

The sewing machine is then turned on, and the first buttonhole sewing operation takes place. At the end of the sewing operation, the sewing machine 1 is stopped with the needle up, the threads are cut off, and by actuation of the knife bar 54 the buttonhole slit is cut with knife 55. Thereupon the cloth clamp 19 is lifted off the pattern cut W by actuation of its holder lever 11, and the step motor 43 is turned on. The latter drives the transverse shaft 27, and hence the draw-off roller 23, endless belt 24 and roller 25, through the cardan shaft 44. By these transport means the pattern cut W is displaced by the distance between two adjacent buttonholes in the direction of arrow V, FIG. 2. This displacement takes place after completion of each buttonhole. The step motor 43 permits easy alteration of the size of the displacement to obtain different spacings and their exact maintenance.

By the guide plate 37, or respectively by its deflection edge 36 extending at an angle to the displacement direction, arrow V, the pattern cut W is bent upward and deflection around the deflection edge 34, extending at the same angle, of the guide plate 35, by the deflection rod 38. By roller 25 protruding through the opening 33 in guide plate 35 upwardly into the draw-off path of the deflection region of the pattern cut W, a downward sliding, caused by gravity, of the pattern cut W passed over the downwardly inclined deflection rod 38 is prevented and its orderly removal angularly to the displacement direction, arrow V, is ensured. Thus the device brings about both the intermittent displacement of the pattern cut W before its deflection by the draw-off roller 24, by the endless belt 24 and by roller 25 as well as the removal of the pattern cut W after the deflection by roller 25 which, because of its somewhat greater diameter, has a somewhat higher circumferential speed than the draw-off roller 23 and the endless belt 24. Since the transport means 23 to 25 continuously remain in engagement with the pattern cut W until the buttonhole row is completely sewn, the distances between the buttonholes can be maintained exactly without the possibility of an unintended change of position during the particularly intermittent displacement.

While specific embodiments of the invention have been shown and described in detail to illustrate the application of the principles of the invention, it will be understood that the invention may be embodied otherwise without departing from such principles.

What is claimed is:

1. An indexing device for moving a workpiece along a draw-off path to a plurality of sewing positions at spaced intervals in a sewing machine for the forming of stitch groups at the positions, such as a row of buttonholes, which stitch groups are sewn by a reciprocating needle of the sewing machine operating on the workpiece as it is advanced through the draw-off path, comprising a draw-off roller disposed alongside the needle, first transport means spaced laterally from said draw-off roller, second transport means offset laterally and rearwardly in the draw-off path from said first transport means, and drive means connected to said draw-off roller, said first transport means and said second transport means to drive them in synchronism.

2. A feed device according to claim 1, wherein said draw-off roller comprises a roller engageable with the material alongside the needle, said roller having a roller shaft, said first transport means including a rotating roller member having a roller member shaft connected to the drive shaft of said roller, a belt extending from said roller member to said second transport means, said second transport means comprising a roller of larger diameter than said roller member, said drive means including a drive motor and a cardan shaft connected between said drive motor and the sleeve between said draw-off roller and said roller member.

3. A device according to claim 1, including a deflection rod extending into the draw-off path for deflecting the workpiece therearound into a second draw-off path disposed at an angle to said first-mentioned draw-off path.

4. An indexing device for moving a workpiece along a draw-off path to a plurality of sewing positions at spaced intervals in a sewing machine for the forming of stitch groups at the positions, such as a row of buttonholes, which stitch groups are sewn by a reciprocating needle of the sewing machine operating on the workpiece as it is advanced through the draw-off path, comprising a draw-off roller disposed alongside the needle, first transport means spaced laterally from said draw-off roller, second transport means offset laterally and rearwardly in the draw-off path from said first transport means, and drive means conected to said draw-off roller, said first transport means and said second transport means to drive them in synchronism, said second transport means comprising a second roller, a drive member interconnecting said second roller with said first transport means, said second roller having a higher circumferential speed than said first transport means and including a lead guide having an opening through which said second roller extends into the draw-off path.

5. A device according to claim 4, wherein said lead guide comprises a deflecting bar, the free length of said deflecting bar being substantially equal to the expanse of said workpiece in the region of the deflecting edge of said lead guide.

6. A device according to claim 5, wherein said sewing machine includes a work shifting frame which is movable into an operative and an inoperative position, said feed device being connected with said frame.

7. An indexing device for moving a workpiece along a draw-off path to a plurality of sewing positions at spaced intervals in a sewing machine for the forming of stitch groups at the positions, such as a row of buttonholes, which stitch groups are sewn by a reciprocating needle of the sewing machine operating on the workpiece as it is advanced through the draw-off path, comprising a draw-off roller disposed alongside the needle, first transport means spaced laterally from said draw-off roller, second transport means offset laterally and rearwardly in the draw-off path from said first transport means, and drive means connected to said draw-off roller, said first transport means and said second transport means to drive them in synchronism, said draw-off roller comprising a roller engageable with the material alongside the needle, said roller having a roller shaft, said first transport means including a rotating roller member having a roller member shaft connected to the drive shaft of said roller, a belt extending from said roller member to said second transport means, said second transport means comprising a roller of larger diameter than said roller member, said drive means including a drive motor and a cardan shaft connected between said drive motor and the sleeve between said draw-off roller and said roller member.

8. A device according to claim 7, including a lead guide in the form of a plate having a deflection edge for deflecting the material at an angle to its feed path to the sewing machine into a draw-off direction and a deflection rod extending into the lead guide in a position to contact the material.

* * * * *